United States Patent [19]

Arashida

[11] Patent Number: 4,967,810

[45] Date of Patent: Nov. 6, 1990

[54] MULTI-COLOR LOADING MACHINES FOR COSMETIC PASTE MATERIALS

[75] Inventor: Mitsuo Arashida, Kanagawa, Japan

[73] Assignee: Nanyo Factory Co., Ltd., Kawasaki, Japan

[21] Appl. No.: 373,202

[22] Filed: Jun. 30, 1989

[30] Foreign Application Priority Data

Jul. 9, 1988 [JP] Japan ..... 63-171597

[51] Int. Cl.[5] ..... B65B 31/00

[52] U.S. Cl. ..... 141/59; 366/139

[58] Field of Search ..... 366/139, 150, 154, 162, 366/163, 164, 176; 141/9, 59, 65

[56] References Cited

U.S. PATENT DOCUMENTS 4,159,028 6/1979 Barker ..... 141/9

4,636,085 1/1987 Kopernicky ..... 366/139

4,887,409 12/1989 Israel ..... 141/9

*Primary Examiner*—Robert W. Jenkins

*Attorney, Agent, or Firm*—Wenderoth, Lind & Ponack

[57] ABSTRACT

A multi-color loading machine for efficiently loading successive feeds of various cosmetic pastes in containers which comprises in combination a tank including a mechanism for stirring the cosmetic pastes, a self-suction type of discharge plunger pump connected to a conduit extending from the tank, a loading machine body located adjacent to the plunger pump and equipped with a loading valve cylinder for supplying a feed of the cosmetic pastes fed in by the plunger pump, a loading manifold connected to the loading machine body and having a plurality of passages running therethrough, and a plate disposed in a region such that it retains a container set in a work holder located above the loading manifold and having a passage for a solvent contained the cosmetic pastes.

8 Claims, 4 Drawing Sheets

MULTI-COLOR LOADING MACHINES FOR COSMETIC PASTE MATERIALS

BACKGROUND OF THE INVENTION

1. Field of the Invention

The present invention relates to a multi-color loading machine for efficiently loading successive feeds of various cosmetic pastes in containers.

2. Prior Art

Various methods have been considered as means to load and solidify cosmetic paste materials in containers. As an example, use is often made of a method for loading cosmetic pastes into containers from their back sides.

The above method involves loading the cosmetic pastes in the containers from their back sides and, at the same time, sucking and removing solvents contained therein by the actuation of a vacuum suction mechanism from their front sides and the method is used as means for efficiently loading and solidifying the cosmetic pastes.

According to the above means, the cosmetic pastes are stored in a previously pressurized tank or a cosmetic paste feeder under pressure. In order to load a suitable cosmetic paste feed, it is supplied from said tank or feeder through a supply conduit to a loading nozzle for loading into the container and, at the same time, the cosmetic paste is solidified by the actuation of the vacuum suction mechanism.

However, in such a conventional method for loading cosmetic pastes as mentioned above, wherein the cosmetic paste feed is stored in a previously pressurized tank or a cosmetic paste feeder under pressure, the unit needed for cosmetic paste feed loading comprises a larger number of mechanisms and parts, leading to problems such as increases in the size, weight and cost of the overall system. Another problems with this method are that a completely constant loading of the cosmetic paste feed is not achievable and much time and labor are needed to replace the cosmetic paste feed for color changing purposes.

With the aforesaid conventional loading method, it is also very difficult to regulate the density and rate of loading and other like factors due to compressed air being used to feed the cosmetic paste under pressure. This poses problems such as the occurrence of irregularities or traces of a loading opening on the surface of the products, which gives rise to another problem such as increased inferior products. In particular, it is impossible to carry out loading at the desired high density, since the density of cosmetic paste feed loading cannot be increased to higher than the pressure of compressed air (about 8 $Kg/cm^2$). When the cosmetic paste feed is vacuum-sucked simultaneously with loading, only a part of the solvent present on the surface portion of the loaded cosmetic paste feed is sucked, so that there is a variation in the density of loading within the product. Moreover, with the conventional loading method, it is needed to increase the degree of vacuum for loading to a value higher than required. For that reason, the content shrinks after drying to such an extent that it tends to disengage the conainer, thus making it impossible to retain predetermined falling strength. This offers an additional problem in that some limitations are placed on the formulation of cosmetic paste materials.

SUMMARY OF THE INVENTION

In view of the foregoing, the present invention has been made with a view to overcoming the defects of such a conventional multi-color loading machine. Therefore, an object of the present invention is to provide a multi-color loading machine for cosmetic paste feeds which can as a whole be decreased in size and weight, assures a constant loading of cosmetic paste feeds, permits cosmetic paste feeds to be loaded at a low degree of vaccum but an increased density of loading so as to overcome any variation in the interior loading density of the product, and can reduce both the length of time and the amount of labor needed for the replacement of cosmetic paste feeds for color changing purposes.

According to one aspect of the present invention, there is provided a multi-color loading machine for cosmetic paste feeds which, in order to attain such an object as stated above, comprises in combination:

- a tank including a mechanism for stirring said cosmetic paste feeds,
- a self-suction type of discharge plunger pump connected to a conduit extending from said tank,
- a loading machine body located adjacent to said plunger pump and equipped with a loading valve cylinder for supplying a feed of cosmetic pastes fed in by said plunger pump,
- a loading manifold connected to said loading machine body and having a plurality of passages running therethrough, and
- a plate disposed in a region such that it retains a container set in a work holder located above said loading manifold and having a passage for a solvent contained in said feed of said cosmetic pastes.

According to another aspect of the present invention, there is provided a structure which further includes a suitable paper or cloth material applied on the bottom side of said plate.

According to still another aspect of the present invention, there is provided a structure which further includes said loading manifold having a passage for feeding a predetermined amount of said cosmetic paste feeds to said loading machine body and said work holder for setting a container to be loaded with said cosmetic paste feeds, while connected to said loading manifold through a nozzle.

According to a further aspect of the present invention, there is provided a structure which further includes a plurality of solvent passages formed on said work holder for continuously guiding a solvent forced out of said feed of cosmetic pastes loaded and an attachment connected to a suction source such as vacuum means and having a solvent reservoir in which said solvent guided through said solvent passages is stored.

In a preferred embodiment of the present invention, a cosmetic paste feed guided out of the tank is supplied into the loading machine body through the self-suction type of discharge plunger pump, then passed from the loading valve cylinder provided to said loading machine body into the loading manifold in a given quantity, and finally loaded and fed into the container set on the work holder from its back side. On the other hand, an amount of the solvent contained in the cosmetic paste feed and loaded into the container from its back side and is forced out thereof is instantaneously discharged through the solvent passage plate disposed above the position at which said container is retained in place and provided therethrough with a plurality of solent passages. In the meantime, that solvent is stored in the solvent reservoir defined in the attachment provided to said solvent passage plate and connected to a suction source such as vacuum means. After the completion of loading of the cosmetic paste feed in the container, the sovent stored in the solvent reservoir is then evacuated from the loading machine body under the sucking action of the suction source connected to the attachment, while the cosmetic paste feed is solidified.

DESCRIPTION OF THE PREFERRED EMBODIMENTS

Figure 1A:
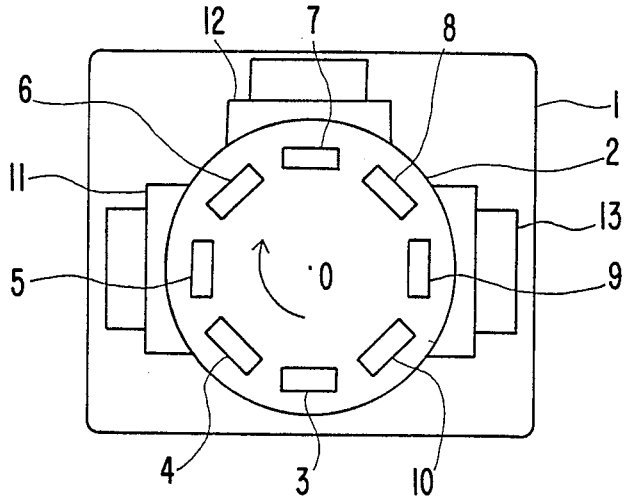
FIGS. 1*a* and 1*b* are general plan views showing the systems used for the application of the present invention, which differ in the number of the work stations set in place.
Figure 1B:
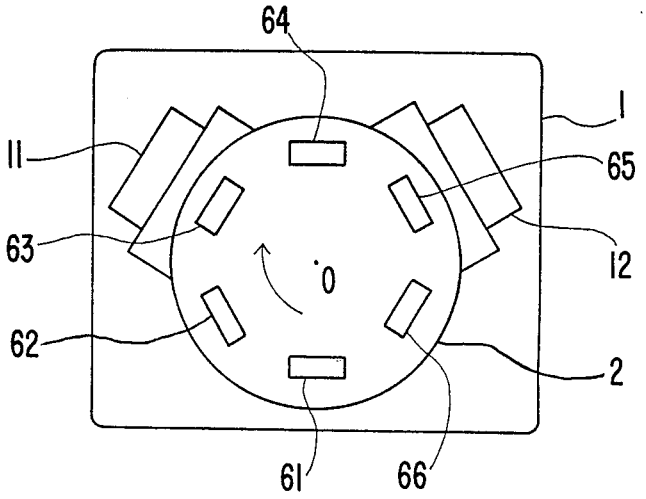

FIGS. 1*a* and 1*b* each are a plan view of the general structure of the systems used in the application of the present invention. Referring to FIG. 1*a*, there is shown a plan view of one embodiment of the system in which eight work stations are set in place, as will be described later, and referring to FIG. 1*b*, there is shown a plan view of another embodiment of the system in which six work stations are set in place. As a matter of course, it is understood that no limitation is imposed upon the number of said work stations to be set in place.

Referring first to FIG. 1 *a*, a unit base 1 is provided thereon with a circular turntable 2 designed to rotate around 0 at a given speed. Mounted on and along the peripheral edge of the turntable 2 are 1st, 2nd, 3rd, 4th, 5th, 6th, 7th and 8th work stations 3, 4, 5, 6, 7, 8, 9 and 10. Operating units 11, 12 and 13 are located at predetermined positions of the turntable 2.

The first work station 3 is used to feed a container to be loaded with a cosmetic paste feed, and the second work station 4 to detect the presence and misalignment of the container. The third or fourth work station 5 or 6 is used to load the cosmetic paste feed in the container and recover a solvent in the loaded cosmetic paste feed, and the fifth, sixth or seventh work station 7, 8 or 9 to subject the loaded cosmetic paste feed to pressing. The eighth work station 10 is used for automatic removal of the container.

As a matter of course, it is understood that the 1st to 8th work stations 3 to 10 are not limited to such a mode of operation as mentioned above, if such feeding and discharging of the container as mentioned above are achievable.

Figure 2:
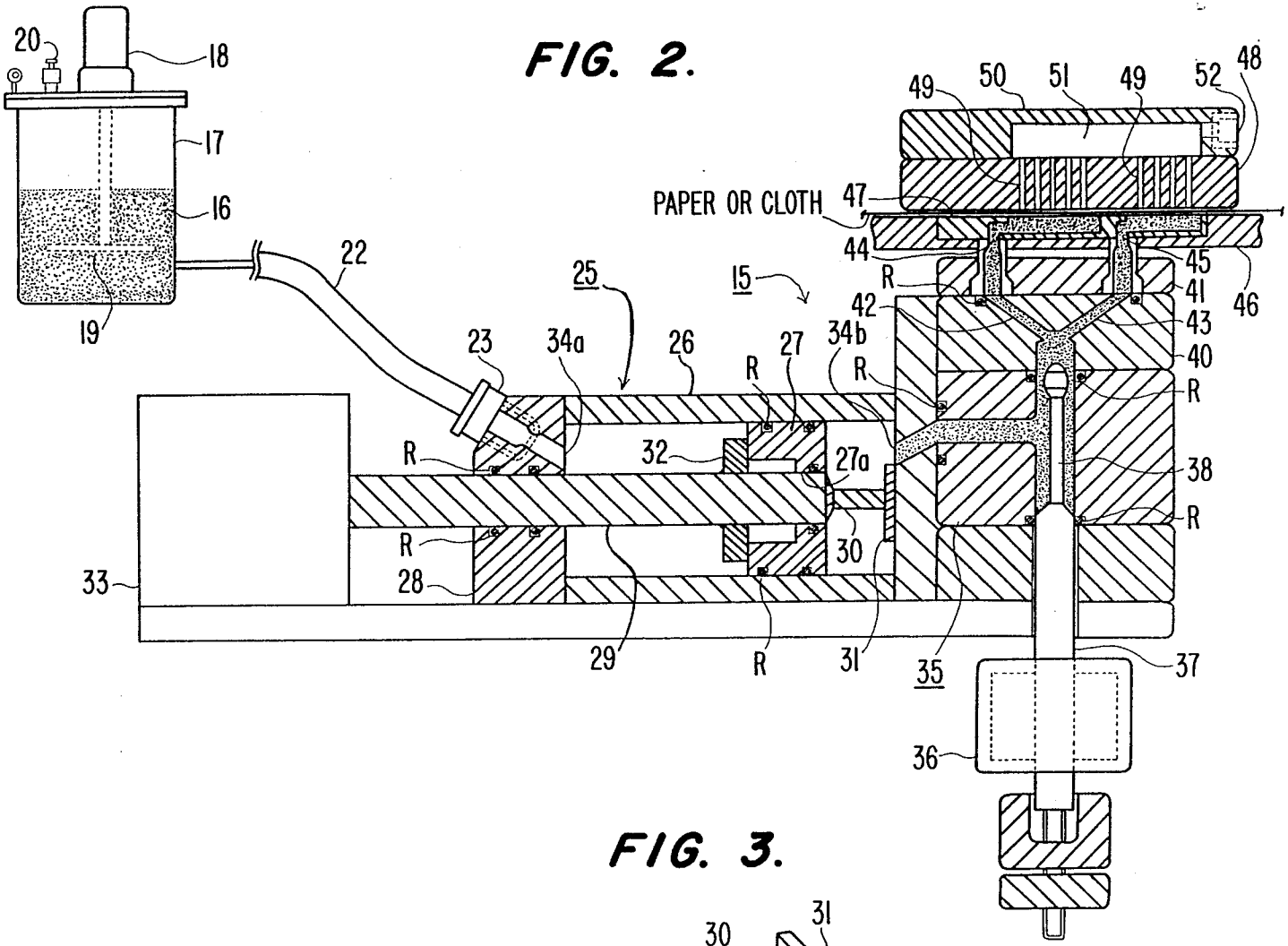
FIG. 2 is a sectional view of part of the multi-color loading machine for cosmetic paste feeds used in the present invention.

With such an arrangement, a given container is first placed on the first work station 3, whereby the following steps are automatically and successively performed. More specifically, the container is carried onto the second work station 4 to detect its presence and misalignment by the movement of the circular turntable 2 revolving at a predetermined speed. Subsequently, a cosmetic paste feed is successively loaded in the container on the 3rd or 4th work station 5 or 6 by making use of a multi-color loading machine as illustrated in FIG. 2 and will be described later, followed by the recovery of a solvent from the loaded cosmetic paste feed. The cosmetic paste is then subjected to pressing on the 5th, 6th or 7th work station 7, 8 or 9, and the container is finally automatically discahrged from the 8th work station 10. In this manner, the overall steps are completed.

Referring to FIG. 1*b*, there is illustrated a turntable 2 on which six work stations are set in place, as previously mentioned. In this case, the turntable 2 is provided thereon with 1st, 2nd, 3rd, 4th, 5th and 6th work stations 61, 62, 63, 64, 65 and 66.

According to the work station arrangement as illustrated in FIG. 1*b*, a given container is first placed on the first work station 61 and then carried onto the 2nd work station 62 to detect its presence and misalignment by the movement of the circular turntable 2 revolving at a predetermined speed. Subsequently, a cosmetic paste feed is successively loaded in the container on the 3rd work station 63 by making use of the multi-color loading machine as illustrated in FIG. 2 to be described later, followed by the recovery of a solvent contained in the cosmetic paste feed with a vacuum suction mechanism, not shown. The cosmetic paste feed is then subjected to pressing on the 4th or 5th work station 64 or 65, and the container is finally automatically discharged from the 6th work station 66. In this manner, the overall steps are completed.

As a matter of course, it is again understood that the 1st to 6th work stations 61 to 66 illustrated in FIG. 1*b* are not limited to such a mode of operation as mentioned above, if such feeding and discharging of the container as mentioned above are achievable.

FIG. 2 is a sectional view generally showing one embodiment of a multi-color loading machine 15 forming an essential part of the present invention, which is to be used in association with the 3rd and 4th work stations 5 and 6 of FIG. 1*a* or the 3rd work station 63 of FIG. 1*b*.

Referring to the structure of the multi-color loading machine 15, a tank 17 is provided to store therein a cosmetic paste feed 16. Disposed on the tank 17 is a stirring motor 18 having its stirring blade 19 extending and terminating in the tank 17. Numerical 20 denotes a safety valve.

A conduit 22 extends from one lower side portion of the tank 17 and is connected to a self-suction type discharge plunger pump 25 by way of a one-touch joint 23. The pump 25 comprises a cylinder 26 and a free piston 27 slidably inserted into the cylinder 27 through a wall section 28. The pump 25 essentially includes a rod 29 detachably insertable through a bore 27*a* in the free piston 27, a guide member 31 fixed to an extreme end of the rod 29 through a support rod 30, a flange 32 fixed on an intermediate portion of the rod 29, a feed inlet 34*a* for feeding the cosmetic paste 16 into the cylinder 26 and a discharge outlet 34*b* for supplying the cosmetic paste 16 from within the cylinder 26 to the next step, and a driving source 33 for reciprocating the rod 29 in the cylinder 26. The operation of the self-suction type of discharge plunger pump 25 will be later explained with reference to FIGS. 4, 5 and 6.

Figure 3:
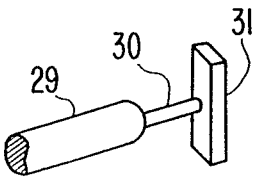
FIG. 3 is a perspective view showing a part of the machine of FIG. 2, and FIGS. 4, 5 and 6 are sectional views illustrative of the operation of the self-suction type of discharge plunger pump used in the present invention.

The guide member 31 is in the form of an elongate member, as illustrated in FIG. 3, and reciprocates in the cylinder 26 in association with the rod 29.

A loading machine body 35 is located adjacent to the self-suction type of discharge plunger pump 25, and includes a loading valve cylinder 36. A rod 37 extending from the valve cylinder 36 extends in the loading machine body 35 and engages a needle 38.

Fixed to the loading machine body 35 are two loading manifolds 40 and 41, one manifold 40 being provided with a plurality of passages 42 and 43 and the other manifold 41 with nozzles 44 and 45 for which use may be made of open, pressing or other suitable nozzles.

A work holder 46 is provided with a recess in which a dish-like container 47 is set. In a plate 48 provided to pass therethrough a solvent contained in the loaded cosmetic paste feed, there are a plurality of solvent passages 49 . . . 49, which are accommodative to the range of an opening in the container 47. An attachment 50 is connected to a suction source, not shown, and includes a space defining a solvent reservoir 51 in which a solvent contained in the cosmetic paste feed loaded in the container 47 is discharged and stored, instantaneously upon loading, through the solvent passage running through the plate 48. The solvent discharged and stored in the reservoir 51 is evacuated from the loading machine through a solvent discharge port 52 under the sucking action of the suction source connected to the attachment 50.

Usually, a suitable thin paper or cloth material is fixedly interposed between the work holder 46 and the solvent passage plate 48.

It is noted that the loading machine body 35 is equipped with a temperature sensor and a heater to normally keep the interior temperature of said body 35 at a constant level. In FIG. 2, R stands for an O-ring.

In order to load the cosmetic paste feed with such an arrangement, the cosmetic paste 16 is first supplied into the tank 17 and then sufficiently stirred by the stirring blade 19 in operative association with the stirring motor 18. As the driving source 33 for the self-suction type of discharge plunger pump 25 is actuated under such conditions, the cosmetic paste 16 is fed into the loading machine body 35 under the sucking action of said plunger pump 25.

The self-suction type of discharge plunger pump 25 operates as follows.

Figure 4:
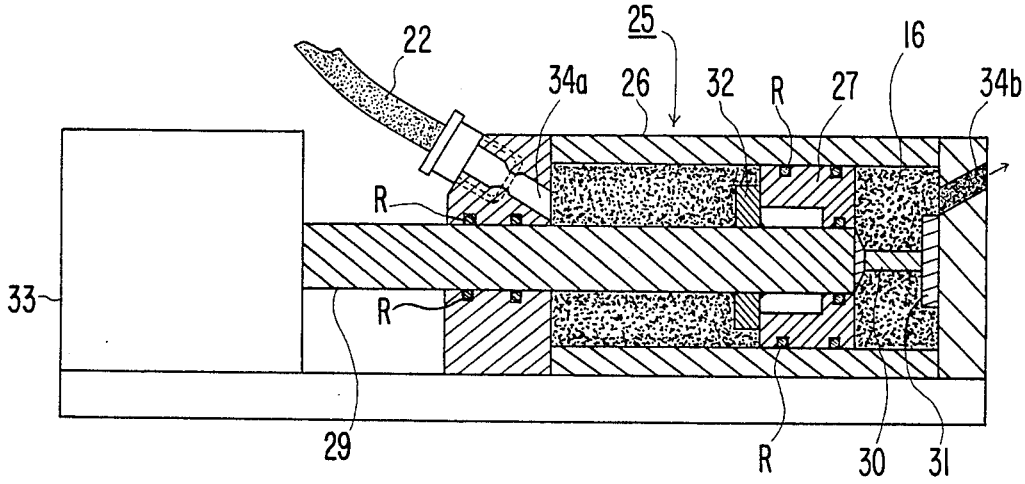

As illustrated in FIG. 4, a driving force of the driving source 33 allows the flange 32 fixed to the intermediate portion of the rod 29 to give a rightward push to the free piston 27, so that the rod 29 and free piston 27 reach their rightmost positions. Consequently, the cosmetic paste 16 in the cylinder 26 and on the right side of the free piston 27 is discharged from the discharge port **34*b* to the loading machine body 35 and, at the same time, a fresh cosmetic paste 16 is sucked from the feed inlet 34*a* into the cylinder 26 under the sucking action of the free piston 27**.

Figure 5:
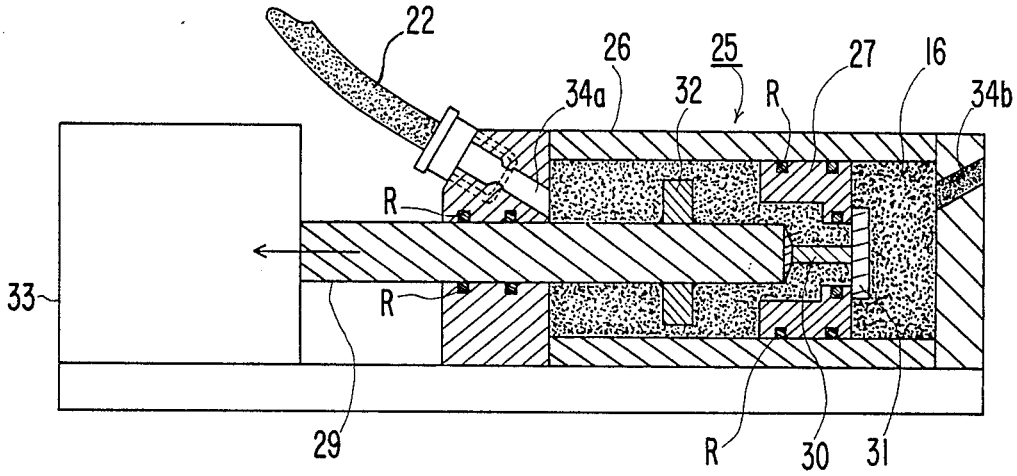
Figure 6:
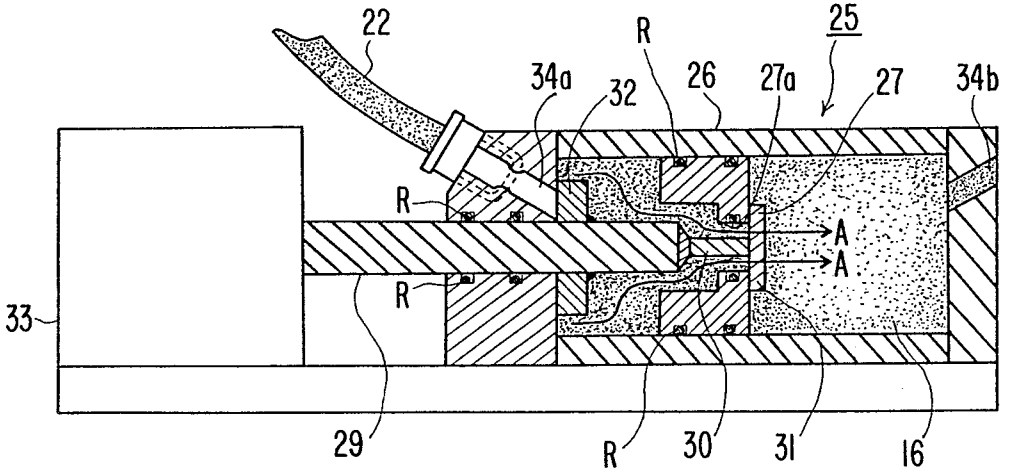

Subsequent driving of the driving source 33 to move the rod 29 in the leftward direction, the flange 32 fixed to the intermediate portion of the rod 29 disengages the free piston 27, as illustrated in FIG. 5. At the same time, the guide member 31 fixed to the extreme end of the rod 29 engages the free piston 27. As the rod 29 is further moved in the leftward direction by the driving force of the driving source 33, the cosmetic paste 16 passes through the central bore **27*a* in the free piston 27 and flows rightward of the free piston 27. In other words, FIG. 6 illustrates the rod 29 and free piston 27 which reach the leftmost positions. As the rod 29 is again moved from this state in the rightward direction, the cosmetic paste 16 sucked in the cylinder 26 is discharged toward the loading machine body 35 through the discharge port 34*b*. The foregoing operations are repeated to provide successive feeds of the cosmetic paste 16 from within the tank 17 to the loading machine body 35**.

In this manner, the cosmetic paste 16 is fed into the self-suction type of discharge plunger pump 25. Then, when the loading valve cylinder 36 provided to the loading machine body 35 is driven to extend the rod 37, a predetermined amount of the cosmetic paste 16 is fed into the loading manifold 40 by the rod 37 and needle 38, then passes through a plurality of passages running through the loading manifold 40 and is finally supplied to the container 47 set in the work holder 46 by way of the nozzles 44 and 45 provided in the other loading manifold 41. At the same time, a vacuum suction source, etc. connected to the attachment, although not illustrated, is driven to continuously remove the solvent contained in the cosmetic paste through the solvent passages 49 . . . 49 running through the plate 48, whereby one cycle of loading of the cosmetic paste feed is completed.

As already stated, the solvent contained in the cosmetic paste loaded in the container 47 is discharged and stored, instantaneously upon its loading, in the reservoir 51 in the attachment 50 through the solvent passages 49 . . . 49 running through the plate 48, and is subsequently evacuated from the loading machine body through the discharge port 52 under the sucking action of the suction source at the time of the completion of loading into the container 47.

By continuing the foregoing operation, it is possible to successively load fresh cosmetic paste feeds 16 into fresh containers 47.

During the operations, the interior temperature of the loading machine body 35 is always kept constant by the heater actuated by the temperature sensor provided thereto.

With the self-suction type of discharge plunger pump 25, it is possible to vary the density of loading of the cosmetic paste 16 by the adjustment of the driving force of the driving source 33.

With the loading machine according to the present invention, it is possible to not only regulate the amount, density and rate of loading of the cosmetic paste feed but also permit easy color changing and constant feeding of cosmetic pastes, thus to obtain a multi-color loading machine well assured of a constant loading of cosmetic paste feeds and the replacement of cosmetic paste feeds for color changing purposes.

It is understood that the prsent invention is not limited to the foregoing specific embodiments and various modifications are possible within the purport thereof. In the self-suction type of discharge plunger pump referred to above, the discharge port **34*b* for the cosmetic paste feed is in engagement and communication with the loading machine body 35, as illustrated in FIG. 2. However, said discharge port 34*b* may be connected to the loading machine body 35** by suitable means such as a hose for communication purposes.

According to one aspect of the present invention, there is provided a multi-color loading machine for cosmetic paste feeds which, as detailed above, comprises in combination:

- a tank including a mechanism for stirring said cosmetic paste feeds,
- a self-suction type of discharge plunger pump connected to a conduit extending from said tank,
- a loading machine body located adjacent to said plunger pump and equipped with a loading valve cylinder for supplying a feed of cosmetic pastes fed in by said plunger pump, a loading manifold connected to said loading machine body and having a plurality of passages running therethrough, and a plate disposed in a region such that it retains a container set in a work holder located above said loading manifold and having a passage for a solvent contained in said feed of cosmetic pastes.

According to another aspect of the present invention, there is provided a structure which further includes a suitable paper or cloth material applied on the bottom side of said plate.

According to still another aspect of the present invention, there is provided a structure which further includes said loading manifold having a passage for feeding a predetermined amount of said cosmetic pastes to said loading machine body and said work holder for setting a container to be loaded with said feed of cosmetic pastes, while connected to said loading manifold through a nozzle.

According to a further aspect of the present invention, there is provided a structure which further includes a plurality of solvent passages formed on said work holder for continuously guiding a solvent forced out of said feed of cosmetic pastes loaded and an attachment connected to a suction source such as vacuum means and having a solvent reservoir in which said solvent guided through said solvent passages is stored.

Thus, the loading machine for cosmetic pastes according to the present invention has the following actions and effects.

A cosmetic paste guided out of the tank is fed into the loading machine body on the basis of the sucking action of the self-suction type of discharge plunger pump, and a predetermined feed of the cosmetic paste is supplied from the loading valve cylinder provided to the loading machine body toward the loading manifold. Thus, it is possible to very simply regulate the density and rate of loading of the cosmetic paste. Besides, it is possible to obtain a constant loading of the cosmetic paste feed and dispense with a pressurizing mechanism used conventionally for cosmetic paste loading, thus resulting in reductions in the complexity, weight and cost of the machine system. The safety of the present machine is very high on account of removed fear of tank explosion, etc., since any pressurizing tank used conventionally for cosmetic paste loading is not needed at all.

It is also possible to considerably reduce the length of the preparatory time required for the replacement of cosmetic pastes such as color changing with some improvements in workability as a result.

Furthermore, the cosmetic paste feed can be loaded at a low degree of vacuum and at a uniform density so that its falling strength after drying can be increased. This is because after the cosmetic paste feed is supplied under pressure in the container from its back side through a plurality of passages defined through the loading manifold fixed to the loading machine body, the solvent forced out of the cosmetic paste feed is guided, discharged and stored in the solvent reservoir through the solvent passages under the actions of the solvent passage plate disposed at such a position that the container is retained in place and the attachment provided to the solvent passage plate and connected to a suction source such as vacuum means and, then, sucked and evacuated from the solvent reservoir. By the replacement of the loading manifold, it is also possible to change the loading passage and the nozzle provided therein and, hence, cope with freely and rapidly the shapes of containers, the types of cosmetic pastes and so on.

Moreover, since the rate of occurrence of inferior products can be considerably reduced as neither indends nor traces of a loading opening is left on the surface of products, it is possible to extend the range of formulation of cosmetic pastes.

According to the present invention, on the other hand, the overall steps can be automatically and successively performed on the respective work stations provided on the periphery of the circular turntable only by placing the container for loading cosmetic pastes on the first work station, so that the operation for loading cosmetic pastes in the container can be simplified. Furthermore, since the present invention is such that the solvent forced out of the cosmetic paste during loading or after the completion of loading is instantaneously stored and vacuum-sucked, any secondary loading works, etc. are not needed at all because indends are not formed on the surface of the cosmetic paste after loading.

What is claimed is:

1. A multi-color loading machine for cosmetic pastes which comprises in combination:

a tank including a mechanism for stirring said cosmetic paste feeds, a self-suction type of discharge plunger pump connected to a conduit extending from said tank, a loading machine body located adjacent to said plunger pump and equipped with a loading valve cylinder for supplying a feed of said cosmetic pastes fed in by said plunger pump, a loading manifold connected to said loading machine body and having a plurality of passages running therethrough, and a plate disposed in a region such that it retains a container set in a work holder located above said loading manifold and having a passage for a solvent contained said feed of cosmetic pastes.

2. A multi-color loading machine as claimed in claim 1, which further includes a suitable paper or cloth material applied on the bottom side of said plate.

3. A multi-color loading machine as claimed in claim 2, which further includes said loading manifold having a passage for feeding a predertermined amount of said cosmetic pastes to said loading machine body and said work holder for setting a container to be loaded with said cosmetic pastes, while connected to said loading manifold through a nozzle.

4. A multi-color loading machine as claimed in claim 3, which further includes a plurality of solvent passages formed on said work holder for continuously guiding a solvent forced out of the cosmetic pastes loaded and an attachment connected to a suction source such as vacuum means and having a solvent reservoir in which said solvent guided through said solvent passages is stored.

5. A multi-color loading machine as claimed in claim 2, which further includes a plurality of solvent passages formed on said work holder for continuously guiding a solvent forced out of the cosmetic pastes loaded and an attachment connected to a suction source such as vacuum means and having a solvent reservoir in which said solvent guided through said solvent passages is stored.

6. A multi-color loading machine as claimed in claim 1, which further includes said loading manifold having a passage for feeding a predertermined amount of said cosmetic pastes to said loading machine body and said work holder for setting a container to be loaded with said cosmetic pastes, while connected to said loading manifold through a nozzle.

7. A multi-color loading machine as claimed in claim 6, which further includes a plurality of solvent passages formed on said work holder for continuously guiding a solvent forced out of the cosmetic pastes loaded and an attachment connected to a suction source such as vacuum means and having a solvent reservoir in which said solvent guided through said solvent passages is stored.

8. A multi-color loading machine as claimed in claim 1, which further includes a plurality of solvent passages formed on said work holder for continuously guiding a solvent forced out of the cosmetic pastes loaded and an attachment connected to a suction source such as vacuum means and having a solvent reservoir in which said solvent guided through said solvent passages is stored.

* * * * *